US007158041B2

(12) United States Patent
McDonald, Jr. et al.

(10) Patent No.: US 7,158,041 B2
(45) Date of Patent: Jan. 2, 2007

(54) ELECTRICAL PROTECTION DEVICE AND METHOD FOR A COMMUNICATION CIRCUIT

(75) Inventors: James N. McDonald, Jr., Greenacres, WA (US); Gregory L. Bentley, Wallace, ID (US)

(73) Assignee: Northern Technologies, Inc., Liberty Lake, WA (US)

( * ) Notice: Subject to any disclaimer, the term of this patent is extended or adjusted under 35 U.S.C. 154(b) by 189 days.

(21) Appl. No.: 10/863,323

(22) Filed: Jun. 8, 2004

(65) Prior Publication Data

US 2005/0270164 A1 Dec. 8, 2005

(51) Int. Cl.
*G08B 21/00* (2006.01)

(52) U.S. Cl. ..... 340/635; 340/636.17; 340/641; 340/659

(58) Field of Classification Search ..... 340/635, 340/636.17, 641, 650, 657, 659, 662, 660, 340/664
See application file for complete search history.

(56) References Cited

U.S. PATENT DOCUMENTS

| | | | | |
|---|---|---|---|---|
| 4,964,160 | A | 10/1990 | Traube et al. | 379/412 |
| 5,299,088 | A | 3/1994 | Honl et al. | 738/185 |
| 5,612,580 | A | 3/1997 | Janonis et al. | 541/442 |
| 5,666,255 | A | 9/1997 | Muelleman | 361/111 |
| 5,790,359 | A | 8/1998 | Kapp et al. | 953/778 |
| 5,790,360 | A | 8/1998 | Ryan | 361/111 |
| 5,864,454 | A | 1/1999 | Zaretsky | 361/127 |
| 5,896,265 | A | 4/1999 | Glaser et al. | 361/119 |
| 5,914,662 | A | 6/1999 | Burleigh | 340/635 |
| 5,966,283 | A | 10/1999 | Glaser et al. | 361/119 |
| 6,118,639 | A | 9/2000 | Goldstein | 361/55 |
| 6,160,692 | A | 12/2000 | Zaretsky | 361/86 |
| 6,304,188 | B1 | 10/2001 | Subak et al. | 340/638 |
| 6,377,435 | B1 | 4/2002 | Nabell et al. | 361/119 |
| 6,384,583 | B1 | 5/2002 | Lestician | 323/276 |
| 6,392,554 | B1 * | 5/2002 | Lee et al. | 340/657 |
| 6,404,348 | B1 * | 6/2002 | Wilfong | 340/657 |
| 6,430,019 | B1 | 8/2002 | Martenson et al. | 361/124 |
| 6,477,025 | B1 * | 11/2002 | Goldbach et al. | 361/103 |
| 6,486,641 | B1 | 11/2002 | Scoggins et al. | 323/257 |
| 6,535,369 | B1 * | 3/2003 | Redding et al. | 361/111 |
| 6,549,388 | B1 | 4/2003 | Robinson | 361/111 |
| 6,625,000 | B1 * | 9/2003 | Jakwani et al. | 361/118 |
| 6,664,771 | B1 | 12/2003 | Scoggins et al. | 323/257 |
| 6,690,283 | B1 * | 2/2004 | Nemoto et al. | 340/664 |
| 6,879,478 | B1 * | 4/2005 | Mendoza et al. | 361/93.1 |
| 7,023,680 | B1 * | 4/2006 | Johnson et al. | 361/111 |
| 2002/0024326 | A1 | 2/2002 | Lestician | 323/276 |
| 2002/0075622 | A1 | 6/2002 | Robinson | 361/117 |
| 2002/0191360 | A1 | 12/2002 | Colombo et al. | 361/93.1 |
| 2003/0133245 | A1 | 7/2003 | Masghati et al. | 361/119 |
| 2003/0133246 | A1 | 7/2003 | Masghati | 361/119 |

* cited by examiner

*Primary Examiner*—Toan N. Pham
(74) *Attorney, Agent, or Firm*—Harness, Dickey & Pierce

(57) ABSTRACT

A protection device for a communication circuit that includes a sensor monitoring a protection device parameter and an indication module coupled to the sensor. The indication module generates an indication output as a function of the protection device parameter indicating a protection device event. The indication module receives power from an indication power source separate from the telecommunication signal. Also a method for protecting a telecommunication signal with a protection device including sensing a protection device parameter indicating a protection device event. The method also includes powering an indication module from an indication power source that is separate from the telecommunication signal. The method further includes generating an indication output from the indication module as a function of the protection device parameter indicating the protection device event.

39 Claims, 2 Drawing Sheets

ELECTRICAL PROTECTION DEVICE AND METHOD FOR A COMMUNICATION CIRCUIT

FIELD OF THE INVENTION

The present invention relates to a protection device for use in telecommunication systems and more specifically to a high speed data line surge suppression device having a failure indication output.

BACKGROUND OF THE INVENTION

In telecommunication systems, protection devices are employed to protect equipment from the effects of lightning or other high voltage surges and unwanted voltages of lower magnitude. A protector device is placed in a connection between a telephone exchange line of the local telecommunication provider and telecommunication equipment often at a customer location. The protection device protects the equipment connected to the exchange line from extraneous power sources and surges.

The protection device includes an input transmit and receive connection with the exchange facility and an output transmit and receive connection with the protected equipment. The protection device includes a mechanism for automatically disconnecting one or both of the input or output connections in the presence of a prolonged over voltage surge. The protective mechanism includes a voltage suppressor operatively coupled to the transmit and receive connections to the incoming line. Also included is one or more normally closed fusible links which are sensitive to voltage surges. The fusible links become open when an excessive current or voltage is applied to the fusible link thereby providing a protective function. Typically, each fusible link has a predetermined voltage rating or threshold. Additionally, often protection devices include a voltage suppressor, transformer, and a relay that may be connected between the transmit and receive connections within the protection device to protect connected telecommunication equipment from power and surge transients.

Semiconductor based components of telecommunication equipment are susceptible to excessive voltage including transient over voltages that last only a few microseconds. Transient Voltage Surge Suppression (TVSS) protection devices, which are often referred to as surge suppressors and voltage-clamping devices, are commonly used in suppressing such over voltage transients to protect voltage-surge intolerant telecommunication equipment.

In operation, one or more of the fusible links in the protection device becomes open when the incoming transmit and/or receives experiences a voltage or current surge greater than a predetermined amount. When a fusible link becomes open, the connection path between the input telecommunication transmit and/or receives becomes open and the signal is not provided to the output transmit and/or receive terminals of the protection device. As such, the communication path becomes disconnected and the communication provided by the communication facility is interrupted. In such a case, the telecommunication equipment and/or the communication user may determine that the communication has ceased to operate, however, neither the user or the telecommunication service provider can identify the source of the outage as being an open circuit or fuse within the protection device.

In some cases, protection devices may include a visual indicator such as an LED, flag, or pin. However, in order to identify the source of the outage being the open fusible link, a person must attend to the protection device and visually observe the visual indicator.

As such, the inventors have identified a need for a protection device for a telecommunication facility wherein the status of an open condition of a fusible link within the protection device may be identified from a location remote from the protection device. Furthermore, the inventors have identified the need for remote monitoring of the protection device in order to provide an alarm or indicator signal to a remote location when a fusible link of the protection device becomes open.

Generally surge suppression devices shunt damaging electrical energy to earth ground to protect attached equipment from damage from energy surges on the serving communication facility. Typically, these surge suppression devices can protect against energy surges that are less than or equal to a maximum energy level. When an energy level greater than the maximum level occurs, surge suppression devices commonly sacrifice themselves to provide for protection of the equipment. When the surge suppression device sacrifices itself, the device generally disconnects the incoming line from the equipment line which results in a disruption of the communication circuit and service provided by the communication facility. The disconnection results either from an opening of the normally closed circuit such as when a fuse blows or by a shorting of the circuit to ground which draws the communication signal to ground.

Generally, the service provider and the communication user are not provided with an indication of the failure of the surge suppression device except as may be indicated by a disruption of the communication service or an alarm notification associated with such carried service. In some cases surge suppression devices have been equipped with a visual indicator on the surge suppression device itself such as a light or light emitting diode. However, visual indicators require a person such as a technician visually inspect the visual indicators which helps in repair and maintenance of the facility, but does not help in remotely identifying the source and location of the problem.

Visual indicators in protective devices are configured to be powered by a portion of the energy of the communication signal to provide an indication of when the suppression circuit is working or has failed. However, the communication signal is sensitive to energy drains and may in fact cease working due solely to the energy requirements of the visual indicator. As such, visual indicators are not typically provided in protective devices.

Recognizing these and other problems and limitations of other systems, the inventors of the present invention have developed a surge suppressor system and method for data communication lines that provides, among other benefits, an indication of an event such as a failure of a surge suppression capability of the surge suppressor without requiring energy from the communication facility or service. The event indication may provide for a local visual indication and/or a remote indication signal when a surge suppression circuit sacrifices in response to a protection of the equipment from an energy surge on the incoming facility.

SUMMARY OF THE INVENTION

One aspect of the invention is a protection device that has an input interface for coupling to an input communication medium and an output interface for coupling to an output communication medium. The device also has a suppression module coupled to the input interface and the output interface that provides a transfer limit between the input interface and the output interface. The input interface and output interface are coupled to transfer a telecommunication signal between the input communication medium and the output communication medium. The protection device includes a sensor monitoring a protection device parameter. The device also includes an indication module coupled to the sensor. The indication module generates an indication output as a function of the protection device parameter indicating a protection device event. The indication module receives power from an indication power source separate from the telecommunication signal.

In another aspect of the present invention, a communication circuit electrical protection device includes an input interface for coupling to an input communication medium and an output interface for coupling to an output communication medium. The input interface and output interface are coupled to transfer a telecommunication signal between the input communication medium and the output communication medium. The device also includes a suppression module coupled to the input interface and the output interface. The suppression module provides a transfer limit between the input interface and the output interface. The device further includes a sensor monitoring a protection device parameter. The device also includes an indication module coupled to the sensor that generates an indication output as a function of the protection device parameter indicating a protection device event. The indication module receives power from an indication power source that is separate from the telecommunication signal.

In yet another aspect of the present invention, a device for protecting a telecommunication signal includes means for sensing a protection device parameter. The protection device parameter being indicative of a protection device event. The device also includes means for powering an indication module from an indication power source that is separate from the telecommunication signal. The device further includes means for generating an indication output from the indication module as a function of the protection device parameter indicating the protection device event.

In still another aspect of the present invention, a method for protecting a telecommunication signal with a protection device including sensing a protection device parameter indicating a protection device event. The method also includes powering an indication module from an indication power source that is separate from the telecommunication signal. The method further includes generating an indication output from the indication module as a function of the protection device parameter indicating the protection device event.

Further aspects of the present invention will become apparent from the detailed description provided hereinafter. It should be understood that the detailed description and specific examples, while indicating the preferred embodiments and implementations of the invention, are intended for purposes of illustration only and are not intended to limit the scope of the invention.

BRIEF DESCRIPTION OF THE DRAWINGS

The present invention will become more fully understood from the detailed description and the accompanying drawings.

Corresponding reference characters indicate corresponding parts throughout the several views of the drawings.

DETAILED DESCRIPTION

The following description is merely exemplary in nature and is not intended to limit the invention, its application, or uses.

In one embodiment, the invention is a protection device for a telecommunication circuit. The protection device has an input interface for coupling to an input communication medium and an output interface for coupling to an output communication medium. The input interface and output interface are coupled to transfer a telecommunication signal between the input communication medium and the output communication medium. The device also has a suppression module coupled to the input interface and the output interface to provide a transfer limit between the input interface and the output interface. The protection device includes one or more sensors monitoring one or more protection device parameters. The device also includes an indication module coupled to the sensor. The indication module receives power from an indication power source that is separate and independent from the protected telecommunication signal. The indication module generates an indication output when the sensed protection device parameter indicates an occurrence of a protection device event.

Figure 1:
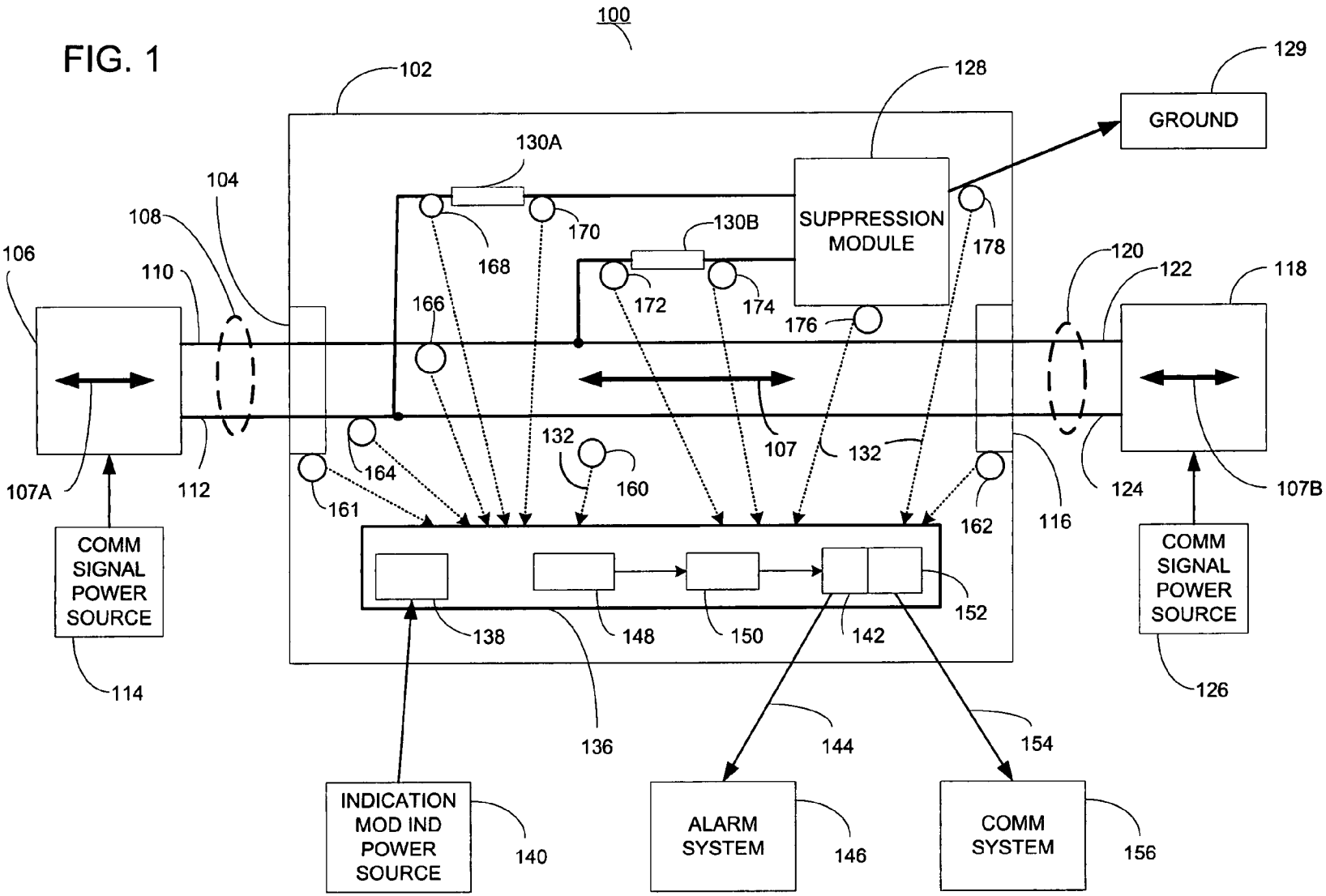
FIG. 1 is a block diagram of a protection device according to one embodiment of the invention.

Referring to FIG. 1, one embodiment of a protection device 100 is illustrated. Protection device 100 includes an input interface 104 that couples protection device 100 to an input communication medium 106 for transmitting and receiving a telecommunication signal 107 (shown in input communication medium 106 as 107A). Input telecommunication signal 107A may receive powering from input communication signal power source 114. Traditionally, communication power source is provided at the transmitting office or location of telecommunication signal 107. In some embodiments, the coupling is via an input facility 108 that may include, in some embodiments, an input tip 110 connection and an input ring 112 connection that are known in the industry. In some embodiments, a tip connection may be associated with a transmit lead and a ring connection may be associated with a receive lead. An output interface 116 is coupled to an output communication medium 118 for transmitting and receiving telecommunication signal 107 (shown in the output communication medium 107 as 107B). Output communication signal 107B may receive powering from output communication signal power source 126. In some embodiments, the coupling is via an output facility 120 that may include an output tip 122 connection and an output ring 124 connection. It should be understood by one skilled in the art that telecommunication signal 107 is typically a duplex or bi-directional signal that transmits information or data in both directions. As such, while the discussion identifies one or more components as an input or an output, this identification is for descriptive purposes and is not intended to be so limiting. Additionally, input communication power source 114 and output communication power source 126 may be separate power sources or in some embodiments may be the same power source.

Telecommunication signal 107 may be any type of communication signal for transmitting and receiving communication information. This may include a T1 or DS1 signal, a T2 or DS2 signal, a T3 or DS3 signal, an E1 signal, an E2 signal, and E3 signal, a DSL signal, a 10Base-T signal, a 100Base-T signal, a 1000Base-T signal, and ISDN signal.

Input communication medium 106 and output communication medium 118 may include any communication medium capable of transmitting and receiving a telecommunication or communication signal. This includes a twisted pair, a telephone company local loop, a local area network, a wide area network, a coax, and a wireless network. Similarly input communication facility 108 and output communication facility 120 may include a tip and ring arrangement as illustrated in FIG. 1 for a twisted pair communication medium or may include a coax, or another type of communication facility suitable for carrying telecommunication signal 107.

Input interface 104 and output interface 116 may include any suitable coupling device or method for coupling protection device 100 to a communication medium or facility. This may include an RJ-45 interface, RJ-11 interface, a wired terminal interface, a punch interface, and a coax interface.

Input interface 104 and output interface 116 are coupled within protection device 100 to transmit telecommunication signal 107 between the two interfaces. A suppression module 128 is connected to telecommunication signal 107 within protection device 100 to provide for a suppression of energy and/or a transfer limit between input interface 104 and output interface 116. Suppression module 128 may be directly connected to telecommunication signal 107 or may be connected via one or more fusible links 130. Two such fusible links are illustrated in FIG. 1 to connect the suppression module to the tip and ring connections carrying telecommunication signal 107. In this illustrated embodiment, a first fusible link 130A is connected between ring connections 112 and 124. A second fusible link 130B is connected between the tip connections 110 and 122.

Suppression module 128 may be any type of electronic or electrical circuit or configuration providing a transfer limit between input interface 104 and output interface 116 and therefore to transferred telecommunication signal 107. The transfer limit between input interface 104 and output interface 116 is limit or threshold for a voltage level, a current level, a power level, or generally an energy level. Suppression module 128 may be a silicon avalanche diode (SAD), zener diode, sidactor, metal oxide varistor, thyristor, gas discharge tube, resistor, transformer, capacitor, inductor, or a positive thermal coefficient (PTC) device. In some embodiments, suppression module 128 may include one or more of these components or hybrids thereof, or may include other electrical or electronic components. For example, in one embodiment where suppression module 128 includes a transient voltage surge suppressor (TVSS), the transfer limit includes a clamping voltage of the transient voltage surge suppressor. The clamping voltage may be any predetermined voltage. In one example, clamping voltage is 13 volts peak. In other embodiments, clamping voltage is in the range of 10 to 15 volts peak. In other embodiments, the transfer limit may be a current. For example, in one embodiment the transfer current may be 40,000 amps.

In operation, suppression module 128 receives from telecommunication signal 107 energy, voltage, and/or current surges and shunts excess above the predefined transfer limit to an electrical ground 129 to prevent or limit the transfer of the energy surge between input interface 106 and output interface 116, or vice versa.

Fusible link 130 may be any type or configuration of fusible apparatus or method. Generally, fusible link 130 has a threshold energy, voltage, current, or power level that defines a transition of fusible link 130 from a first state to a second state. The first state may be a state conducting energy and the second state terminating or reducing the conduction of energy through fusible link 130. Fusible link 130 may include a fuse, a fuse trace on a printed circuit board, a conductive material fuse, a circuit breaker, a diode, a metal oxide varistor, and a positive thermal coefficient (PTC) device.

Protection device 100 includes at least on protection device sensor 160 for sensing one or more protection device parameters or characteristics of an operation of the protection device. Protection device sensor 160 provides a sensed protection device parameter to an indication module 136. Indication module 136 receives the sensed parameters and provides an indication output. Indication module 136 receives powering from an indication module power source 140 that is separate and independent from input communication signal power source 114, output communication signal power source 126, and/or the telecommunication signal 107. Indication power source 140 may be a battery, a fuel cell, or an external power source such as a local power source associated with an installation of protective device 100. For example, this may include a power source at an equipment cabinet, a controller environment vault, a distribution cabinet, a relay rack, etc.

One or more of sensors 160 provide a protection device parameter that may be indicative of a protection device event that the indication module identifies or determines as being associated with an indication event. In various embodiments, the protection device event may be an electrical characteristic such as a voltage, a current, an energy, a power, a resistance, a capacitance, and an inductance. The protection device event may be predefined to indicate a failure event such as a failure of one or more components of protection device 100 or the ability of protection device to provide a transfer limit to telecommunication signal 107. In another embodiment, the protection device event may be defined to be a near failure of component or process of protection device 100 such as one that may indicate that protection device 100 may not consistently provide the transfer limit or that a failure event may be pending or expected in the near future or with an occurrence of another surge. Similarly, a failure flag event may be one or more events that flag a pending or potential event that requires maintenance or replacement. In another embodiment, a protection device event may be the presence or occurrence of a voltage, current, power, resistance, inductance or capacitance level that is greater than, equal to, or possibly less than a threshold level. In yet another embodiment, the protection device event may be the presence or occurrence of an operational event or administrative event. For example, this may include a lapse of time, a number of cycles, a number of surges, a number of surges greater than a threshold, or a cycling of one or more cycled events or processes within the protective device or telecommunication signal 107. The protection device event may be an instantaneous sensing of a characteristic or may be a change or variation over time, a deviation, or a rate of change in the characteristic.

Indication module 136 generates an indication output in response to receiving the protection device event. The indication output may include the generation of a signal, a communication, or a change in the state of an output device that provides a remote sensing alarm or administration system with an indication of the occurrence of the protection device event. In one embodiment, indication module 136 includes an indication output interface 142 that generates or provides indication output 144 to remote alarm system or administration system 146. Indication output interface 142 may be a switch or relay. In one embodiment, indication output is a switch or relay that has two or more states. Indication output changes its state response to indication module 136 determining the occurrence or presence of a protection device event, thereby providing for a remote indication of the protection device event to a remote alarm system 146. In another embodiment, indication module may include an output communication module 152. Output communication module 152 generates an output communication signal 154 that provides an output communication message to remote communication system 152 indicating the occurrence of protection device event. Additionally, output communication signal 154 and output communication message contained therein may include an identification of a type, category, or value of the protection device event.

Protection device 100 may also include a signal conditioning/processing module 148 and an indicator output driver module 150. Signal conditioning/processing module 148 may receive one or more sensor signals 132 or protection device parameters from sensor 160. Signal conditional/processing module 148 analyzes the received sensor signals 132 and protection device parameter contained therein and determines when one or more protection device events have occurred. When signal conditioning/processing module 148 determines the occurrence or presence of a protection device event, a failure signal is generated and provided to indicator output driver module 150. Indicator output driver module provides a failure indication activation signal responsive to receipt of the failure signal. The failure indication activation signal drivers or generates the indication output interface 142 and/or output communication module 152 to provide output indication 144 or output communication signal 154.

FIG. 1 includes a variety of sensors 160 illustrating some of the embodiments of sensor 160 associated with sensing or monitoring various operations of protection device. These are items 161–178. One or more of sensors 160–178 may provide a protection device parameter to indication module 136. Sensor 161 may sense an operation or characteristic of input interface 104 and sensor 162 may sense output interface 116. Sensors 164 and 166 may sense a characteristic of telecommunication signal 107 or the transfer of energy between input interface 106 and output interface 116, as indicated between tip connections 110 and 122 and ring connections 112 and 124. Sensors 168 and 170 sense an input and output characteristic or parameter of fusible link 130A and sensors 172 and 174 sense an input and output of fusible link 130B. Sensor 176 senses an operating characteristic or parameter of suppression module 128 and sensor 178 senses a parameter or characteristic of the connection of suppression module 128 to ground 129. These are only examples of a variety of sensors that may sense a protection device parameter for determining a protection device event.

In one embodiment of the operation of protection device 100, suppression module 128 includes a transient voltage surge suppressor (TVSS). In such an embodiment, the transfer limit may be a clamping voltage of the transient voltage surge suppressor. Sensor 176 may sense an operating parameter of suppression module 128 that is indicative of a transient voltage surge suppressor event such as a voltage or current exceeding the operational capabilities of the TVSS or may indicate a failure or reduction in the TVSS's ability to suppress further surges.

In another embodiment, fusible link 130A and/or B may be coupled to suppression module 128 and telecommunication signal 107. One or more of sensors 168, 170, 172, and 174 may provide a protection device parameter to indication module 136. Fusible link 130 may have a first state that conducts energy through fusible link 130 and a second state reducing or terminating conduction of energy through fusible link 130. Fusible link 130 may have a predefined threshold energy that defines a transition of fusible link 130 from the first state to the second state. In such, one or more of sensors 168, 170, 172, and 174 may sense an operating parameter that is indicative of the change in state of the fusible link. Indication module 136 monitors any and all of the received parameters from any of the sensors and determines the presence or occurrence of a protection device event. When the protection device event is determined, indication module 136 generates indication output 144 or output communication signal 154 to provide a remote output indication.

As one example, a fusible link parameter may be voltage at the input or output of fusible link 130. Indication module 136 may compare the fusible link voltage to a predetermined fusible link voltage that is predetermined to indicate the presence of a protection device event. If the fusible link voltage is determined to be greater than the predetermined fusible link voltage threshold, indication module 136 generates output indication 144. This may include the changing of a state of indication output module 142 from a first state to a second state.

One skilled in the art would understand that two or more sensor signals 132 and their associated parameters may be utilized by indication module 136 to determine the presence of a protection device event. For instance, sensor signals from both sensor 168 and sensor 170, both associated with fusible link 130A, may be monitored and utilized to determine the state of fusible link 130A and the occurrence of a protection device event such as a change in one of the parameters or an opening or blowing of fusible link 130A In one implementation of the invention, the method provides for the protection of the telecommunication signal with a protection device such as protective device 100. The method includes sensing a protection device parameter and sensing a protection device parameter that is indicative of a protection device event. Indication module 136 is powered by indication power source 140 that is separate from telecommunication signal 107. The method generates indication output 144 from indication module 136 as a function of the protection device parameter indicating the protection device event.

Figure 2:
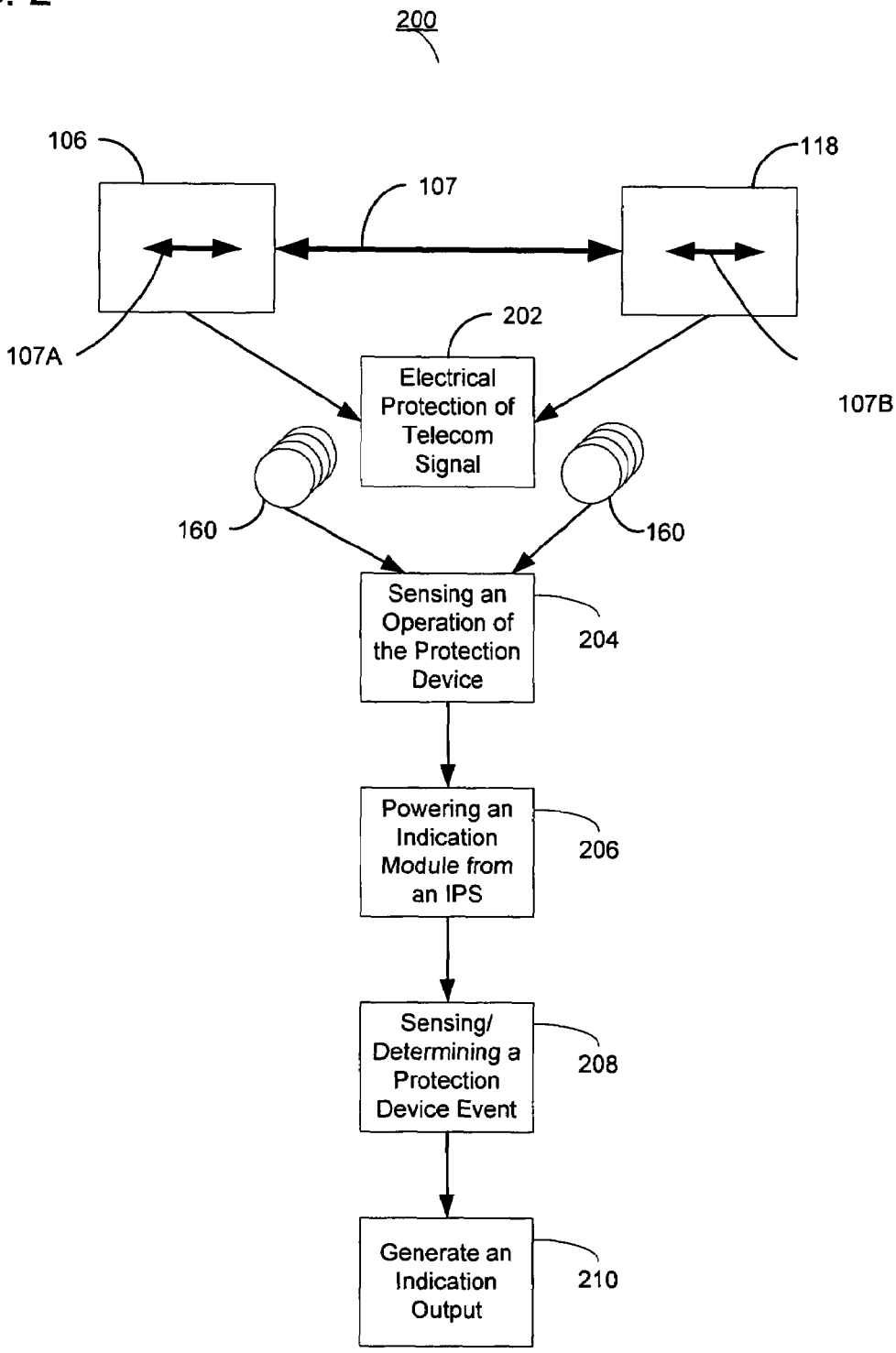
FIG. 2 is a flow chart illustrating a method of protection with a failure indication output according to one implementation of the invention.

Method 200 of FIG. 2 illustrates one implementation of a method consistent with some embodiments of the invention. The operations of method 200 begin with the protection of telecommunication signal 107 in operation 202. In 202, telecommunication signal 107 is received at input interface 104 from input interface signal 107A from input communication medium 106 input interface 104 and is transferred within protection device 100 to output interface 116 and on to output communication medium 118 as output signal 107B. As described above, protection device 100 provides for the protection of telecommunication signal 107 by providing a limit to the transfer within protection device 100. In operation 204, one or more sensors 160, as shown by example in FIG. 1 as 160–178, sense one or more protection device parameters such as an electrical characteristic, of one or more components or operations of protection device 100 or telecommunication signal 107. Indication module 136 is powered by indication power source 140 in operation 206. Indication power source 140 is separate and distinct from telecommunication signal 107. Indication module 136 receives the sensed parameters and determines or identifies the presence or occurrence of a protection device event in operation 208. Upon determination of a protection device event in operation 208, an indication output is generated in operation 210.

While not illustrated in the drawings, it should be understood that the embodiments described herein and one or more of the components, may be implemented in hardware, firmware or software. In one embodiment, each of the described components may be implemented using wired circuit or electronic devices. However, in some embodiment, one or more operating environments for one or more components such as the indication module may include a processing unit that includes at least one high speed processing unit (CPU) (not shown) and a memory system (not shown). The CPU 24 may be of familiar design and include collection of registers for temporary storage of data and instructions and a control unit for controlling operation of the system and executing instructions consistent with the invention. In some embodiments, the invention may operate on an operating system designed to be portable to any of these processing platforms. The memory system may include one or more computer readable medium containing one or more computer executable instructions. As is familiar to those skilled in the art, the processing unit may include an operating system and at least one application program. The operating system is the set of software which controls the computer system's operation and the allocation of resources. The application program is the set of software that performs a task desired by the user, using computer resources made available through the operating system.

The indication output provides operating or maintenance personnel responsible for ensuring proper operation of telecommunication signal 107 to diagnose or repair protection device 100. By enabling remote identification or communication of a protection device event such as a failure or error, maintenance of the telecommunication signal 107 is improved and outages affecting operation and use of telecommunication signal 107 are minimized. Among other benefits, one or more embodiments of the invention provides an efficient and effective method of indicating an occurrence of an event such as a failure of one or more components of a suppression device independent of the powering from the protected communication signal.

When introducing aspects of the invention or embodiments thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that several aspects of the invention are achieved and other advantageous results attained. As various changes could be made in the above exemplary constructions and methods without departing from the scope of the invention, it is intended that all matter contained in the above description or shown in the accompanying drawings shall be interpreted as illustrative and not in a limiting sense.

It is further to be understood that the method operations or steps described herein are not to be construed as necessarily requiring their performance in the particular order discussed or illustrated unless otherwise indicated. It is also to be understood that additional or alternative operations may be employed or implemented.

What is claimed is:

1. A telecommunication protection device including an input interface for coupling to an input communication medium, an output interface for coupling to an output communication medium, and a suppression module coupled to the input interface and the output interface and providing a transfer limit between the input interface and the output interface, said input interface and output interface coupled to transfer a telecommunication signal between the input communication medium and the output communication medium, the protection device comprising:

a sensor for monitoring a protection device parameter; and an indication module coupled to the sensor for generating an indication output indicating a protection device event as a function of the protection device parameter monitored by the sensor, said indication module having an indication power source separate from the telecommunication signal and an output interface for permitting remote detection of said indication output.

2. The protection device of claim 1 wherein the protection device event is selected from the group consisting of a failure event, a near-failure event, a failure flag event, a threshold, an operational event, and an administrative event.

3. The protection device of claim 1 wherein the protection device parameter is selected from the group consisting of a voltage, a current, a power, a resistance, a capacitance, and an inductance.

4. The protection device of claim 1, further comprising a fusible link coupled to the suppression module said fusible link having a first state and a second state, the first state for conducting current through the fusible link, the fusible link having a threshold energy defining a transition of the fusible link from the first state to the second state, wherein the protection device event is indicative of the state of the fusible link.

5. The protection device of claim 4 wherein the sensor monitors at least one of an input fusible link parameter and an output fusible link parameter, said indication module sensing a change in the at least one of the input and output fusible link parameters and determining the state of the fusible link as a function of the sensed change.

6. The protection device of claim 4 wherein the fusible link is selected from the group consisting of a fuse, a fuse trace on a printed circuit board, a conductive material fuse, a circuit breaker, a diode, a metal oxide varistor, and a positive thermal coefficient (PTC) device.

7. The protection device of claim 1 wherein the indication power source is selected from the group consisting of a battery, a fuel cell, and an external power source.

8. The protection device of claim 1 wherein the output interface includes a switching device having two or more states, one of the two states being indicative of the protection device event.

9. The protection device of claim 1 wherein the indication module includes a communication module and the indication output is an output indication signal.

10. The protection device of claim 1 further comprising a fusible link coupled between the suppression module and one of the input interface and output interface; wherein the protection device parameter is associated with at least one of an input to the fusible link and an output to the fusible link; said indication module includes a signal conditioning module for, comparing the protection device parameter to a predetermined fusible link parameter, said indication module generating the indication output as a function of the comparison.

11. The protection device of claim 10 wherein the protection device parameter is voltage and the predetermined fusible link parameter is a predetermined voltage threshold and wherein the indication output is generated as a function of the determined voltage being greater than the predetermined voltage threshold.

12. A telecommunication system comprising:

an input interface for coupling to an input communication medium;

an output interface for coupling to an output communication medium;

a suppression module coupled to the input interface and the output interface and providing a transfer limit between the input interface and the output interface, said input interface and output interface coupled to transfer a telecommunication signal between the input communication medium and the output communication medium;

a sensor for monitoring a protection device parameter;

an indication module coupled to the sensor for generating an indication output indicating a protection device event as a function of the protection device parameter monitoring by the sensor, said indication module having an indication power source separate from the telecommunication signal and an output interface for permitting remote detection of said indication output.

13. The protection device of claim 12 wherein the input circuit interface and the output circuit interface are selected from the list consisting of an RJ-45 interface, RJ-11 interface, a wired terminal interface, a punch interface, and a coax interface.

14. The protection device of claim 12 wherein the telecommunication signal is selected from the group consisting of a T1 signal, a T2 signal, a T3 signal, an E1 signal, an E2 signal, and E3 signal, a DSL signal, a 10Base-T signal, a 100Base-T signal, a 1000Base-T signal, and ISDN signal.

15. The protection device of claim 12 wherein the input and output communication medium is selected from the group consisting of a twisted pair, a telephone company local loop, a local area network, a wide area network, a coax, and a wireless network.

16. The protection device of claim 12 wherein the suppression module includes one or more components and hybrids thereof selected from the group consisting of a silicon avalanche diode (SAD), zener diode, sidactor, metal oxide varistor, thyristor, gas discharge tube, resistor, transformer, capacitor, inductor, and positive thermal coefficient (PTC) device.

17. The protection device of claim 12 wherein the suppression module is a transient voltage surge suppressor (TVSS), wherein the transfer limit is a function of a clamping voltage of the transient voltage surge suppressor, and wherein the parameter is indicative of a transient voltage surge suppressor event.

18. The protection device of claim 12 wherein the protection device event is selected from the group consisting of a failure event, a near-failure event, a failure flag event, a threshold, an operational event, and an administrative event.

19. The protection device of claim 12 wherein the protection device parameter is selected from the group consisting of a voltage, a current, a power, a resistance, a capacitance, and an inductance.

20. The protection device of claim 12, further comprising a fusible link having a first state and a second state, the first state for conducting current through the fusible link, the fusible link having a threshold energy defining a transition of the fusible link from the first state to the second state, wherein the protection device event is indicative of the state of the fusible link.

21. The protection device of claim 20 wherein the sensor monitors at least one of an input fusible link parameter and an output fusible link parameter, said indication module sensing a change in at least one of the input and output fusible link parameters and determining the state of the fusible link as a function of the sensed change.

22. The protection device of claim 12 wherein the protection device parameter is associated with one or more selected from the group consisting of a transmit lead of the input interface, a receive lead of the input interface, a transmit lead of the output interface, a receive lead of the output interface, the suppression module, the indication module, the indication power source, and a ground reference coupled to the suppression module.

23. A method for permitting remote detection of an indication output of a protection device, the protection device coupled to a telecommunication medium for protecting a telecommunication signal, the method comprising:

monitoring a protection device parameter;

generating an indication output as a function of the protection device parameter, the indication output indicating the occurrence of a protection device event;

powering an indication module from an indication power source, said indication power source being separate from the telecommunication signal; and permitting remote detection of said indication output via an output interface.

24. The method of claim 23 wherein the protection device event is selected from the group consisting of a failure event, a near-failure event, a failure flag event, a threshold, an operational event, and an administrative event.

25. The method of claim 23 wherein the protection device parameter includes a state of a fusible link having a first state and a second state, said second state indicating the protection device event.

26. The method of claim 23 wherein said fusible link having a threshold energy defining a transition of the fusible link from the first state to the second state.

27. The method of claim 23 wherein the telecommunication signal is one of a T1 signal, T2 signal, and T3 signal.

28. The method of claim 23 wherein the output interface includes a switching device having at least two states, further comprising changing the state of the switching device in response to the output indication.

29. The method of claim 23 further comprising monitoring a second protection device parameter; the output indication being generated as a function of one of the protection device parameter and the second protection device event.

30. A telecommunication protection device comprising:

an input interface for coupling to an input communication medium;

an output interface for coupling to an output communication medium;

a fusible link coupled to one of the input interface and the output interface;

a suppression module coupled to the fusible link for providing a transfer limit between the input interface and the output interface, the input interface coupled to the output interface to transfer a telecommunication signal therebetween;

at least one sensor for monitoring at least one protection device parameter; and an indication module coupled to the sensor for generating an indication output indicating a protection device event as a function of the protection device parameter monitored by the at least one sensor, said indication module having an output interface for permitting remote detection of said indication output, said at least one protection device parameter being a fusible link parameter of the fusible link.

31. The telecommunication protection device of claim 30 wherein the indication module includes an indication power source separate from the telecommunication signal.

32. The telecommunication protection device of claim 30 further comprising a second sensor for monitoring a second protection device parameter; said indication module coupled to the second sensor for generating the indication output indicating the protection device event as a function of the second protection device parameter.

33. The telecommunication protection device of claim 32 further comprising a second fusible link coupled to the other of the input interface and output interface, the second protection device parameter being a second fusible link parameter of the second fusible link.

34. The telecommunication protection device of claim 32 wherein the second protection device parameter is associated with at least one of the telecommunication signal, the suppression module, the input interface, the output interface, the fusible link and a second fusible link.

35. The telecommunication protection device of claim 30 wherein the protection device parameter is one of a voltage, a current, a power, a resistance, a capacitance, and an inductance.

36. The telecommunication protection device of claim 30 wherein the telecommunication signal is selected from the group consisting of a T1 signal, a T2 signal, and a T3 signal.

37. The telecommunication protection device of claim 30 wherein the output interface includes a switching device having two or more states, and one state of the switching device indicating the protection device event.

38. The telecommunication protection device of claim 30 further comprising a second sensor coupled to the indication module for monitoring an output fusible link parameter, said fusible link parameter being an input fusible link parameter, said indication module comparing the input fusible link parameter and output fusible link parameter, the protection device event being a function of the comparison.

39. The telecommunication protection device of claim 30 further comprising a plurality of sensors, each sensor for monitoring a protection device parameter; said indication output indicating a protection device event as a function of one or more of the protection device parameters.

* * * * *